US005823440A

United States Patent [19]

Clark

[11] Patent Number: 5,823,440

[45] Date of Patent: Oct. 20, 1998

[54] ROTARY SPRINKLER WITH VELOCITY CONTROLLING VALVE

[75] Inventor: Mike Clark, San Marcos, Calif.

[73] Assignee: Hunter Industries, Incorporated, San Marcos, Calif.

[21] Appl. No.: 636,336

[22] Filed: Apr. 23, 1996

[51] Int. Cl.[6] ..... B05B 3/00

[52] U.S. Cl. ..... 239/206; 239/240

[58] Field of Search ..... 239/237, 240, 239/241, 242, 262, 203–206, 570; 267/221; 188/311, 316; 251/48, 51, 52, 54, 55

[56] References Cited

U.S. PATENT DOCUMENTS

| | | | |
|---|---|---|---|
| 3,175,645 | 3/1965 | Schafer et al. | 188/311 |
| 3,656,632 | 4/1972 | Karakashian et al. | 188/316 X |
| 3,713,584 | 1/1973 | Hunter | 239/206 |
| 4,048,905 | 9/1977 | Souslin | 188/316 X |
| 4,280,601 | 7/1981 | Patriquin | 188/316 |
| 4,423,800 | 1/1984 | Kobiske et al. | 188/316 X |
| 4,773,595 | 9/1988 | Livne | 239/242 |
| 4,867,603 | 9/1989 | Chang | 239/570 X |
| 5,123,597 | 6/1992 | Bendall | 239/206 X |
| 5,169,131 | 12/1992 | Shimura | 267/221 |
| 5,375,768 | 12/1994 | Clark | 239/206 X |

*Primary Examiner*—Andres Kashnikow
*Assistant Examiner*—Steven J. Ganey
*Attorney, Agent, or Firm*—Michael H. Jester

[57] ABSTRACT

A sprinkler unit comprises a housing having an inlet for connecting to a source of water, a rotating head mounted in an upper end of the housing and including an outlet for distributing a stream of water outward from the housing, a passage connecting the inlet to the outlet, and a pressure responsive inlet valve including a damper mounted in the passage at the inlet, the damper controlling the rate of opening of the valve for controlling flow of fluid through the valve to the nozzle.

17 Claims, 3 Drawing Sheets

ROTARY SPRINKLER WITH VELOCITY CONTROLLING VALVE

BACKGROUND OF THE INVENTION

The present invention relates to irrigation sprinklers and pertains particularly to an improved water velocity controlling valve.

The artificial distribution of water through irrigation systems is in wide use throughout the world today. One of the most widely used systems, particularly for lawn areas and playing or athletic fields, is the sprinkler system wherein a plurality of sprinkler units are positioned about a land area for distributing water over the surface of the land area. One of the most popular sprinkler units currently in use is a retractable gear driven rotary head that rotates about a generally vertical axis and covers either an arc segment or a full circle. Such units employ a water driven turbine connected through a reduction drive gear train to the sprinkler head in which a nozzle is mounted to direct a stream of water outward in an arc or circle about the rotary axis of the sprinkler unit.

Sprinkler units of this type, particularly larger units are widely used on golf courses and other turf applications. These are frequently subjected to extreme forces over their lifetime of use which can damage them and reduce their useful life. The most serious of these forces result from water hammer and high pressure air surges that occur during winterizing. These high forces can also occur when empty pipes are being filled with water.

Attempts to solve this problem by making the sprinkler units heavier and stronger has been unsatisfactory because of increased costs. The dual medium of water and air has prevented the use of slow opening valves that use the control of the flow out from being successful. Accordingly, there is a need for longer life sprinkler units.

Accordingly, it is desirable that a sprinkler unit be available having means for compensate for or overcome the frequent high forces resulting from normal operation.

SUMMARY AND OBJECTS OF THE INVENTION

Accordingly, it is a primary object of the present invention to provide a sprinkler unit having an improved inlet valve assembly for controlling fluid velocities and reducing high forces normally resulting from high velocity forces.

In accordance with the primary aspect of the present invention, a sprinkler unit is provided with means for controlling inlet air and water and forces generated thereby for extending the life of the unit.

BRIEF DESCRIPTION OF THE DRAWINGS

The above and other objects and advantages of the present invention will become apparent from the following description when read in conjunction with the drawings wherein.

DETAILED DESCRIPTION OF A PREFERRED EMBODIMENT

Figure 1:
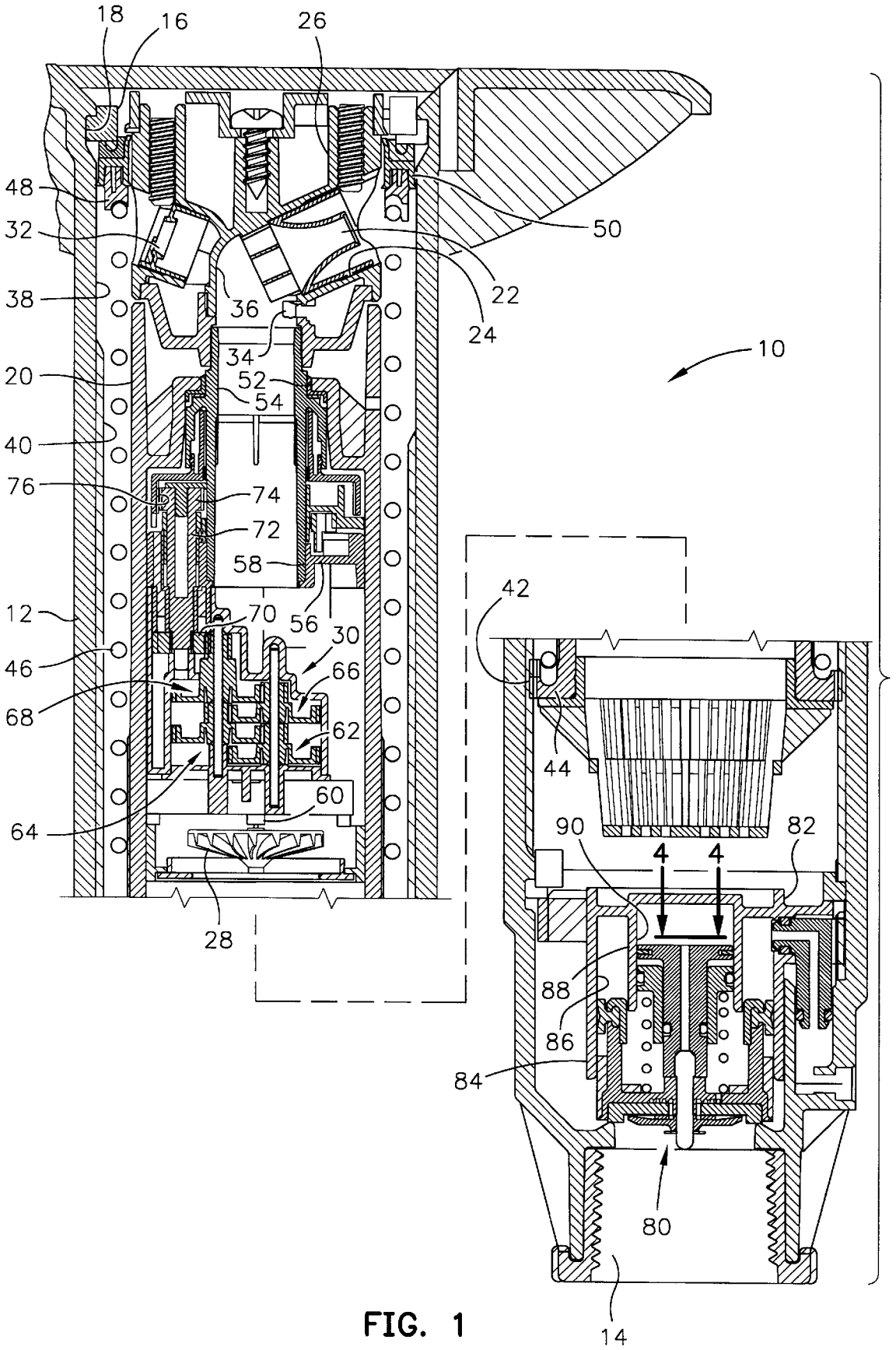
FIG. 1 is a side elevation section view of a sprinkler unit embodying a preferred embodiment of the invention.

Referring to the drawings, particularly to FIGS. 1, there is illustrated a side elevation view in section of a sprinkler unit embodying the present invention, and designated generally by the numeral 10. The sprinkler unit comprises a generally cylindrical tubular outer housing 12, having an inlet opening 14 at one end threaded for mounting to the end of a riser or the like for a source of pressurized water. An outlet end, which is normally disposed and oriented to be the top of the unit, is provided with a suitable retaining ring 16 detachably mounted therein by means of an annular recess 18 for retaining a retractably mounted inner housing or riser 20 in a suitable manner.

The inner tubular housing 20 is retractably mounted in the outer housing 12 for extension upward therefrom and includes a nozzle 22 mounted in an upper or outer end thereof for distributing a stream of water therefrom. The nozzle is mounted in a passage or socket 24 in a rotatable head 26 and rotatably driven by means of turbine 28 through a reduction gear drive gear train designated generally at 30, as more fully described herein below. The particular unit illustrated is designed for golf course and playing field use and to rotate in a part or full circle about a central axis of the housing. A second nozzle 32 is mounted in the head opposite the nozzle 22 and communicates via a port 34 with a through passage 36 to improve the distribution of the stream of water closer in to the unit.

The inner housing or riser 20 is retractably mounted within a bore 38 of the outer housing 12, and is oriented by internal ribs 40 and by means of teeth 42 on radial flange 44 at the lower end thereof. An elongated coil compression spring 46 engages shoulder or flange 44 at the lower end of inner housing 20, and is confined within the bore by means of ring 16 at the upper end. The inner housing or riser 20 is normally biased to the lowermost or retracted position, as illustrated when water pressure is shut off. The terms inner housing and riser are used interchangeably herein.

The inner housing 20 is provided with retracting means in the form of coil compression spring 46, which biases the inner housing to the retracted position (FIG. 1) when water pressure is shut off. The spring 46 is positioned between the annular flange 44 and a ring 48 at the upper end of the housing 12, which biases against outer annular seal assembly 50 retained in position by the retaining ring 16.

The inner housing 20 serves as a riser and carries the rotating head 26 from its retracted position in the outer housing 12, as shown in FIG. 1, to an extended position above the ground surface where the head rotates and distributes water. The inner housing 20 converges at the top with inwardly tapering walls to an opening 52 in which is rotatably mounted a tubular shaft 54, having an upper end extending above the upper end of housing 20 on which the rotating head 26 is mounted. The shaft 54 serves to mount the head 26 convey water from the inlet to the outlet nozzle and transfer torque from the drive train to the rotating head.

The driving assembly for rotating the head 26 is mounted in the inner housing 20 and includes support structure 56 having a journal 58 in which the lower end of the tubular shaft 54 is rotatably mounted. A shoulder surrounds opening 52 and is engaged by a shoulder on rotary shaft 54.

The turbine wheel 28 rotates in response to water flowing through the sprinkler unit and is mounted on a shaft 60 which drivingly rotates a pinion gear which meshes with and drives a reduction gear unit 62 having a larger driven gear and a smaller pinion gear. The reduction gear unit 62 further drives a reduction gear unit 64 which in turn drives a reduction gear unit 66 further driving a reduction gear 68 unit. This reduction gear unit 68 is the final drive unit in the reduction drive assembly 30. This unit, as in previous embodiments, includes a larger driven gear and a smaller driving pinion.

This gear unit 68 falls at the end of the drive train for the reduction drive train for the turbine wheel 28. The gear unit 68 meshes with a gear 70 on a shaft 72 for driving a pinion 74 which in turn drives an internal ring gear 76 which is connected to and driving the tubular shaft 54.

A flow control valve assembly designated generally at 80 is mounted at the inlet of the housing and controls the velocity of fluid entering the sprinkler unit. This valve assembly comprises a housing 82 which may or may not be integral with the sprinkler housing. The housing 82 is of a generally cylindrical configuration and positioned coaxially within the bore of housing 12 adjacent inlet 14. The housing is formed of concentric double cylinders comprising an outer cylinder 84 forming a bore 86 and an inner cylinder 88 forming a bore 90.

Figure 2:
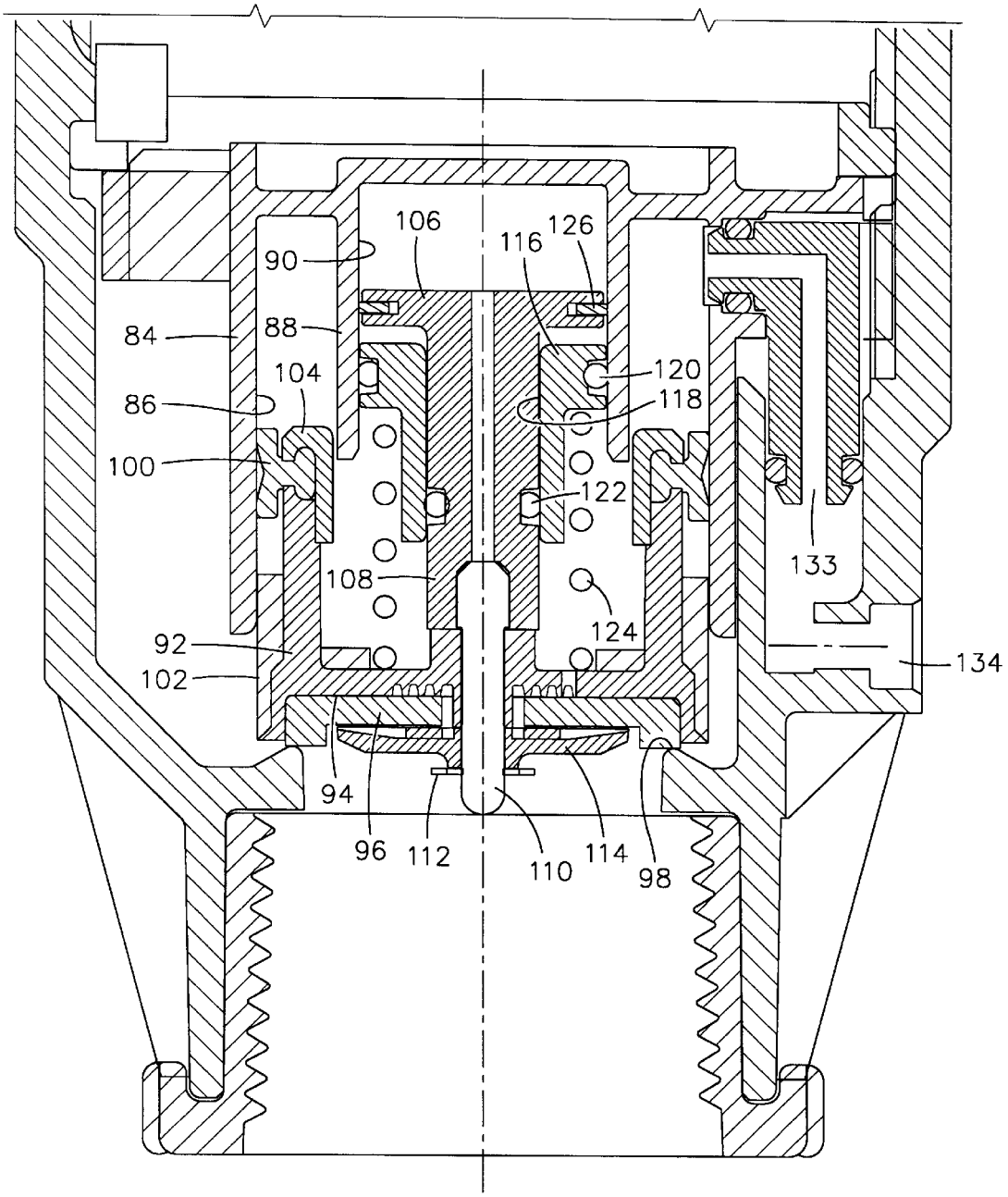
FIG. 2 is a side elevation detailed partial view of the unit of FIG. 1 showing the control valve in the closed position.

Referring to FIG. 2, a valve member 92 has a generally cylindrical configuration including a circular face 94 on which is mounted an elastomeric valve seal 96 for sealingly engaging an annular valve seat 98 surrounding the inlet 14. The valve body 92 is reciprocally mounted in bore 86 by means of an annular seal 100 and guided by a plurality of ribs 102. An annular retainer ring 104 threadably mounts to the interior of valve member 92 and retains seal 100 in place.

A double acting piston 106 is mounted in bore 90 and connected by a piston rod 108 and a pin 110 to the valve member 92. The piston 106 divides the cylinder into two opposed fluid chambers. A retainer washer 112 engages and retains a retainer 114 on pin 110 which retains seal member 100 on the end of the valve member. A floating closure member 116 includes a bore 118 mounting piston rod 108 and closes bore 90 forming a damper chamber for piston 106. The closure is sealed with 0-ring 120 in bore 90 and by 0-ring seal 122 around piston rod 108. A coil compression spring 124 biases against closure member 116 and the back of valve member 92 biasing it toward the closed position engaging seat 98.

Figure 3:
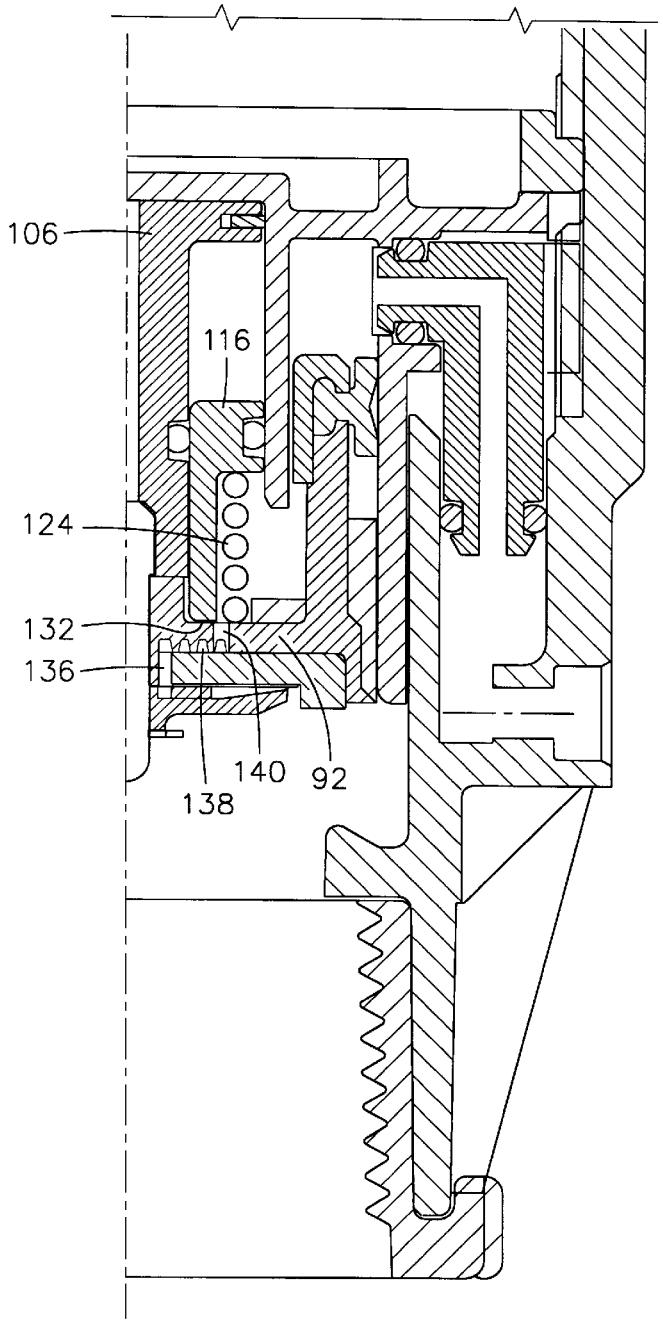
FIG. 3 is a side elevation detailed partial view of the valve FIG. 2 showing the valve in the open position.

The floating closure 116 moves axially toward the valve as the piston 106 moves to the back of bore 90 to accommodate the damping fluid in the smaller area of the chamber on the rod side of the piston. As the piston 106 bottoms out as shown in FIG. 3, an end 132 of a sleeve extension of the closure engages the back surface of valve member 92. The piston 106 includes a piston ring 126 which slidably engages the inner wall or bore 90 of the cylinder.

Figure 4:
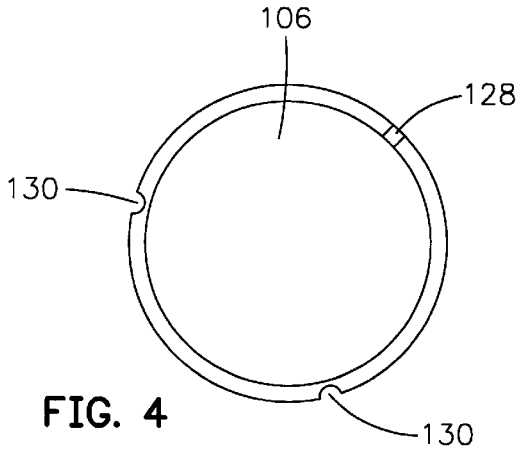
FIG. 4 is a view taken generally on line 4—4 of FIG. 1.

Referring to FIG. 4, the piston ring 126 includes a gap 128 which permits damping fluid to pass to opposite sides of the piston and retard its movement and that of the valve to which it is attached. The ring 126 may also be provided with additional notches 130 which may be selected in number or size to increase the flow of damping fluid and control the rate of opening of the valve.

The valve 92 is pilot operated and the chamber formed behind the valve member 92 is vented via a vent tube 133 to an outlet port 134 of the sprinkler housing where it is vented by a solenoid valve (not shown). The valve member is provided with bleed ports 136 and passages 138 to port 140 to admit water to the chamber at the back of the valve. When the vent valve is closed, water flows through the valve so that the pressure in back of the valve increases to equal the pressure in front, and the valve closes.

In operation, when water under pressure is supplied to the inlet of the sprinkler unit, it acts against the face of valve 92 to force it from its seat 98. The movement of valve 92 is opposed by piston 106 acting on the damping fluid in the chamber. The damping piston allows the valve to move slowly thereby restricting the rate or velocity of flow of water and/ or air into the sprinkler housing. The piston moves back as shown in FIG. 2 as damping fluid moves from back of the piston to the front. This reduces the high forces and impact of high velocity water entering the sprinkler.

While I have illustrated and described my invention by means of specific embodiments, it should be understood that numerous changes and modifications may be made therein without departing from the spirit and scope of the invention as defined in the appended claims:

I claim:

1. A sprinkler unit comprising:

a housing having an inlet for connecting to a source of water, an outlet having a nozzle for distributing a stream of water outward from said housing, and a passage connecting said inlet to said outlet; and a pressure responsive inlet valve assembly including a valve member and damping means mounted in said passage at said inlet, said damping means comprising a cylinder disposed coaxially of said valve member, a double acting piston mounted in said cylinder dividing said cylinder into first and second chambers, and a damping fluid in said chambers constraining movement of said piston thereby controlling the rate of opening of said valve for controlling flow of fluid through said valve to said nozzle.

2. A sprinkler unit according to claim 1 wherein said valve assembly comprises:

a housing having a first cylindrical bore;

said valve member reciprocally mounted in said first bore;

said cylinder is defined by a second cylindrical bore coaxial of said first bore; and said piston is connected to said valve member and reciprocally mounted in said second bore.

3. A sprinkler unit according to claim 2 wherein said second cylindrical bore includes a floating closure, and a compression spring biased against said closure and said valve member for biasing said valve member to a closed position.

4. A sprinkler unit according to claim 1 wherein said piston includes a ring engaging said cylinder wall, said ring including means defining openings enabling said damping fluid to move between said first and second chambers.

5. A sprinkler unit according to claim 4 wherein said cylinder includes a floating closure for said cylinder, and a compression spring biased against said closure and said valve member for biasing said valve member to a closed position.

6. A sprinkler unit according to claim 5 wherein said closure is an annular piston.

7. A sprinkler unit according to claim 1 wherein said cylinder includes a floating closure for said cylinder, and a compression spring biased against said closure and said valve member for biasing said valve member to a closed position.

8. A sprinkler unit according to claim 7 wherein said closure is an annular piston.

9. A sprinkler unit comprising:

a generally cylindrical housing having an inlet coaxially disposed at one end for connecting to a source of water, and an outlet for distributing water outward from said housing, a passage connecting said inlet to said outlet; and a flow control valve assembly in said passage at said inlet, said valve assembly comprising an annular valve seat surrounding said inlet, a first cylindrical bore coaxially of said valve seat, a valve member reciprocally mounted in said first bore for movement into and out of engagement with said valve seat, a cylindrical fluid chamber coaxially of said first cylindrical bore, a piston reciprocally mounted in said chamber and connected to said valve member, a damping fluid in said chamber limiting the rate of movement of said valve member toward and away from said valve seat, and spring means for biasing said valve member into engagement with said valve seat.

10. A sprinkler unit according to claim 9 wherein said cylindrical fluid chamber is formed of a second cylindrical bore having an open end toward said valve seat, and a moveable closure sealingly engaging said piston and said second bore.

11. A sprinkler unit according to claim 10 wherein said piston includes a ring engaging said cylinder wall, said ring including means defining openings enabling said damping fluid to move between first and second sides of said piston.

12. A sprinkler unit according to claim 11 wherein a compression spring is biased against said closure and said valve member for biasing said valve member to a closed position.

13. A sprinkler unit according to claim 10 wherein a compression spring is biased against said closure and said valve member for biasing said valve member to a closed position.

14. A sprinkler unit according to claim 13 wherein said closure is an annular piston.

15. A pop-up rotary sprinkler unit comprising:

an elongated generally cylindrical housing having an inlet coaxially disposed at one end for connecting to a source of water, and an outlet including a nozzle at another end for distributing water outward from said housing, a passage connecting said inlet to said outlet; and a flow control valve assembly in said passage at said inlet, said valve assembly comprising an annular valve seat surrounding said inlet, a first cylindrical bore coaxially of said valve seat, a generally cylindrical valve member reciprocally mounted in said first bore for movement into and out of engagement with said valve seat, a second cylindrical bore defining a cylindrical fluid chamber coaxially of said first cylindrical bore, a double acting piston reciprocally mounted in said chamber and connected to said valve member, a damping fluid in said chamber limiting the rate of movement of said valve member toward and away from said valve seat, and spring means for biasing said valve member toward said valve seat.

16. A sprinkler unit according to claim 15 wherein said second cylindrical bore having an open end toward said valve seat, and a moveable closure sealingly engaging said piston and said second bore.

17. A sprinkler unit according to claim 16 wherein said piston includes a ring engaging said cylinder wall, said ring including means defining openings enabling said damping fluid to move between first and second sides of said piston; and a compression spring biased against said closure and said valve member for biasing said valve member toward said seat.

* * * * *